US009690317B2

(12) United States Patent
Im et al.

(10) Patent No.: US 9,690,317 B2
(45) Date of Patent: Jun. 27, 2017

(54) SEMICONDUCTOR DEVICE AND METHOD OF DRIVING THE SAME

(71) Applicant: SK hynix Inc., Gyeonggi-do (KR)

(72) Inventors: Jong-Man Im, Gyeonggi-do (KR); Jun-Cheol Park, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 14/698,542

(22) Filed: Apr. 28, 2015

(65) Prior Publication Data

US 2016/0179125 A1 Jun. 23, 2016

(30) Foreign Application Priority Data

Dec. 19, 2014 (KR) ..... 10-2014-0184287

(51) Int. Cl.

| | |
|---|---|
| ***G05F 5/00*** | (2006.01) |
| ***H03K 3/012*** | (2006.01) |
| ***H03K 3/037*** | (2006.01) |
| ***G05F 1/66*** | (2006.01) |
| ***H03L 7/00*** | (2006.01) |
| ***H03K 3/015*** | (2006.01) |

(52) U.S. Cl.

CPC ..... *G05F 5/00* (2013.01)

(58) Field of Classification Search

CPC .. G05F 5/00; G05F 1/66; H03K 3/012; H03K 3/037; H03K 3/015; H03L 7/00

USPC ..... 327/142, 143, 198, 530–546; 323/312–317

See application file for complete search history.

(56) References Cited

U.S. PATENT DOCUMENTS

| | | | | |
|---|---|---|---|---|
| 5,936,443 | A * | 8/1999 | Yasuda | H03K 17/223 327/143 |
| 7,049,865 | B2 * | 5/2006 | Parker | H03K 17/223 327/143 |
| 7,271,504 | B2 * | 9/2007 | Wada | G06F 1/26 307/85 |
| 7,564,279 | B2 * | 7/2009 | Tang | H03K 17/223 327/142 |
| 8,836,386 | B1 * | 9/2014 | Hwang | G06F 1/24 327/142 |
| 2003/0038666 | A1 * | 2/2003 | Wada | G06F 1/26 327/530 |
| 2003/0214329 | A1 * | 11/2003 | Shin | H03K 17/223 327/143 |
| 2007/0080726 | A1 * | 4/2007 | Khan | G06F 1/24 327/143 |
| 2010/0007408 | A1 * | 1/2010 | Yamahira | G11C 5/143 327/541 |
| 2011/0095814 | A1 * | 4/2011 | Kim | G11C 5/14 327/538 |

(Continued)

FOREIGN PATENT DOCUMENTS

KR 1020100001835 1/2010

*Primary Examiner* — Brandon S Cole
(74) *Attorney, Agent, or Firm* — IP & T Group LLP

(57) ABSTRACT

A semiconductor device includes: an internal voltage generation block suitable for generating an internal voltage based on first and second external voltages whose power-up sections are different from each other; and a control block suitable for fixing the internal voltage to a predetermined voltage level during a control section including a first power-up section of the first external voltage and a second power-up section of the second external voltage.

16 Claims, 4 Drawing Sheets

(56) References Cited

U.S. PATENT DOCUMENTS

| | | | | |
|---|---|---|---|---|
| 2014/0361816 | A1* | 12/2014 | Sung | H03K 17/223 327/143 |
| 2015/0177763 | A1* | 6/2015 | Koo | G06F 1/26 327/143 |
| 2015/0311885 | A1* | 10/2015 | Lee | G06F 1/24 327/143 |
| 2015/0326218 | A1* | 11/2015 | Byeon | H03K 19/01850 327/143 |

* cited by examiner

SEMICONDUCTOR DEVICE AND METHOD OF DRIVING THE SAME

CROSS-REFERENCE TO RELATED APPLICATIONS

The present application claims priority of Korean Patent Application No. 10-2014-0184287 filed on Dec. 19, 2014, which is incorporated herein by reference in its entirety.

BACKGROUND

1. Field

Exemplary embodiments of the present invention relate to a semiconductor design technology, and more particularly, to a semiconductor device using an external voltage and a method of driving the semiconductor device.

2. Description of the Related Art

In general, a semiconductor device uses an external voltage supplied from a control device as a supply power source.

The external voltage has a power-up section ramping from a ground voltage level to a target voltage level. The external voltage floats between a ground voltage and a target voltage before it approaches the predetermined voltage level.

During the section before approaching the predetermined voltage level, logic elements or circuits using the external voltage as a supply power source may output a logic signal of an unknown state. In other words, when the external voltage is in the floating state, the output of the logic elements or circuits is not clearly defined as logic high or logic low.

Particularly, a predetermined logic element or circuit may output a signal of a logic low level during the power-up section although it was supposed to output a logic high signal as its default value. In contrast, a logic element or circuit may output a logic high signal during the power-up section although it was supposed to output a logic low signal as its default value.

This unstable powering-up section may result in direct current paths being formed in the semiconductor device due to the signals improperly assuming their default values, resulting in current leakage.

SUMMARY

Exemplary embodiments of the present invention are directed to a semiconductor device capable of blocking a direct current path during a section where an external voltage is in a floating state, and a method of driving the semiconductor device.

In accordance with an embodiment of the present invention, a semiconductor device includes: an internal voltage generation block suitable for generating an internal voltage based on first and second external voltages whose power-up sections are different from each other; and a control block suitable for fixing the internal voltage to a predetermined voltage level during a control section including a first power-up section of the first external voltage and a second power-up section of the second external voltage.

The control section may include an intermission between the first and second power-up sections.

A first power-up moment when the first power-up section starts may be earlier than a second power-up moment when the second power-up section starts.

The control block may include: a detection unit suitable for detecting the first power-up section based on the first external voltage and the second power-up section based on the second external voltage; and a driving unit suitable for driving an internal voltage node to a ground voltage during the first and second power-up sections based on a detection result of the detection unit.

The semiconductor device may further include an internal circuit block suitable for blocking a portion of an internal current path during the control section based on the internal voltage.

The internal voltage generation block may be disabled during the second power-up section or the control section based on the detection result of the detection unit.

In accordance with another embodiment of the present invention, a semiconductor device includes: a reference voltage generation block suitable for generating a reference voltage corresponding to a seed voltage based on a second external voltage; an internal voltage generation block suitable for generating an internal voltage corresponding to the reference voltage based on the first external voltage, wherein the internal voltage generation block is disabled in response to first and second power-up signals; a detection block suitable for detecting a first power-up section based on the first external voltage and a second power-up section based on the second external voltage to output the first and second power-up signals; and a driving block suitable for driving an internal voltage node to a ground voltage during a control section including the first and second power-up sections in response to the first and second power-up signals.

A first power-up moment when the first power-up section starts may be earlier than a second power-up moment when the second power-up section starts.

The semiconductor device may further include a control block suitable for fixing the reference voltage to the ground voltage during the second power-up section or the control section in response to at least one of the first and second power-up signals.

The detection block may include: a first detection circuit suitable for detecting the first power-up section of the first external voltage to generate the first power-up signal; and a second detection circuit suitable for detecting the second power-up section of the second external voltage to generate the second power-up signal.

The driving block may include: a first driving circuit suitable for driving the internal voltage node to the ground voltage during the first power-up section in response to the first power-up signal; and a second driving circuit suitable for driving the internal voltage node to the ground voltage during the second power-up section in response to the second power-up signal.

The semiconductor device may further include: a pull-down control block suitable for receiving the internal voltage and generating a pull-down control signal of a logic level corresponding to the internal voltage during the control section; and a voltage supply block suitable for supplying the second external voltage to a first power source line and the ground voltage to a second power source line while blocking a portion of an internal current path during the control section in response to the pull-down control signal.

The pull-down control block may include a level shifter for generating the pull-down control signal in response to an address decoding signal.

The internal current path may include a direct current path that is formed between a supply terminal of the second external voltage and a supply terminal of the ground voltage.

The voltage supply block may include: a third driving circuit suitable for driving the first power source line to the second external voltage in response to a pull-up control signal; an equalization circuit suitable for equalizing the first and second power source lines in response to an equalization signal; and a fourth driving circuit suitable for driving the second power source line to the ground voltage in response to the pull-down control signal, wherein the fourth driving circuit is disabled during the control section.

In accordance with another embodiment of the present invention, a method of driving a semiconductor device includes: maintaining an internal voltage at a ground voltage level during a control section including a first power-up section of a first external voltage and a second power-up section of a second external voltage; generating a pull-down control signal of a logic level corresponding to the internal voltage during the control section; and disabling a sinking block where an internal current path is formed during the control section, based on the pull-down control signal.

The maintaining of the internal voltage at the ground voltage level may include controlling an internal voltage generation block for generating the internal voltage to be disabled.

The first and second power-up sections may start at different moments.

A first power-up moment when the first power-up section starts may be earlier than a second power-up moment when the second power-up section starts.

The internal current path may include a direct current path that is formed between a supply terminal of the second external voltage and a supply terminal of the ground voltage.

DETAILED DESCRIPTION

Exemplary embodiments of the present invention are described below in more detail with reference to the accompanying drawings. These embodiments are provided so that this disclosure is thorough and complete, and fully conveys the scope of the present invention to those skilled in the art. All "embodiments" referred to in this disclosure refer to embodiments of the inventive concept disclosed herein. The embodiments presented are merely examples and are not intended to limit the inventive concept.

It is also noted that in this specification, "connected/coupled" refers to one component not only directly coupling another component but also indirectly coupling another component through an intermediate component. In addition, a singular form may include a plural form as long as it is not specifically mentioned.

Figure 1:
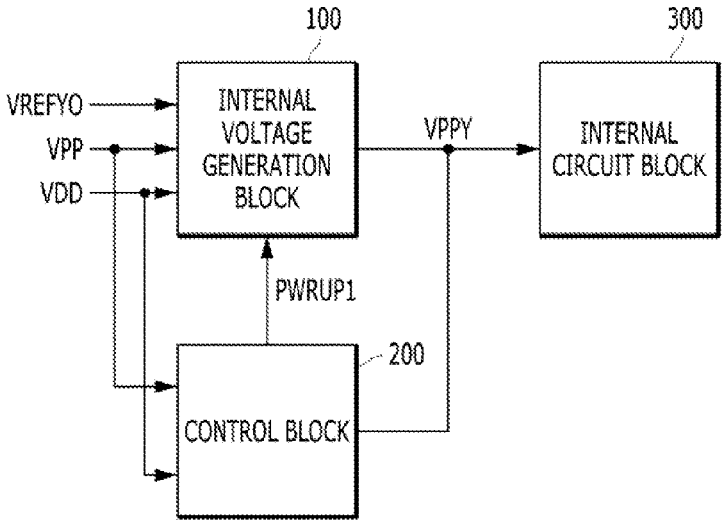
FIG. 1 is a block diagram illustrating a semiconductor device in accordance with an embodiment of the present invention.

FIG. 1 is a block diagram illustrating a semiconductor device in accordance with an embodiment of the present invention.

Referring to FIG. 1, the semiconductor device may include an internal voltage generation block 100, a control block 200, and an internal circuit block 300. The internal voltage generation block 100 generates an internal voltage VPPY corresponding to a seed voltage VREFY0 based on a first external voltage VPP and a second external voltage VDD which has a power-up section different from that of the first external voltage VPP, and is disabled in response to a second power-up signal PWRUP1. The control block 200 fixes the internal voltage VPPY to a predetermined voltage level during a control section including the power-up section of the first external voltage VPP (hereinafter, referred to as a "first power-up section") and the power-up section of the second external voltage VDD (hereinafter, referred to as a "second power-up section"). The internal circuit block 300 blocks a portion of an internal current path during the control section based on the internal voltage VPPY.

Herein, a first power-up moment when the first power-up section starts may be faster earlier than a second power-up moment when the second power-up section starts.

The first power-up section and the second power-up section may not have an overlapping section. In other words, the control section may include an intermission between the first power-up section and the second power-up section.

The control section may include a section when the second external voltage VDD is in a floating state.

Figure 2:
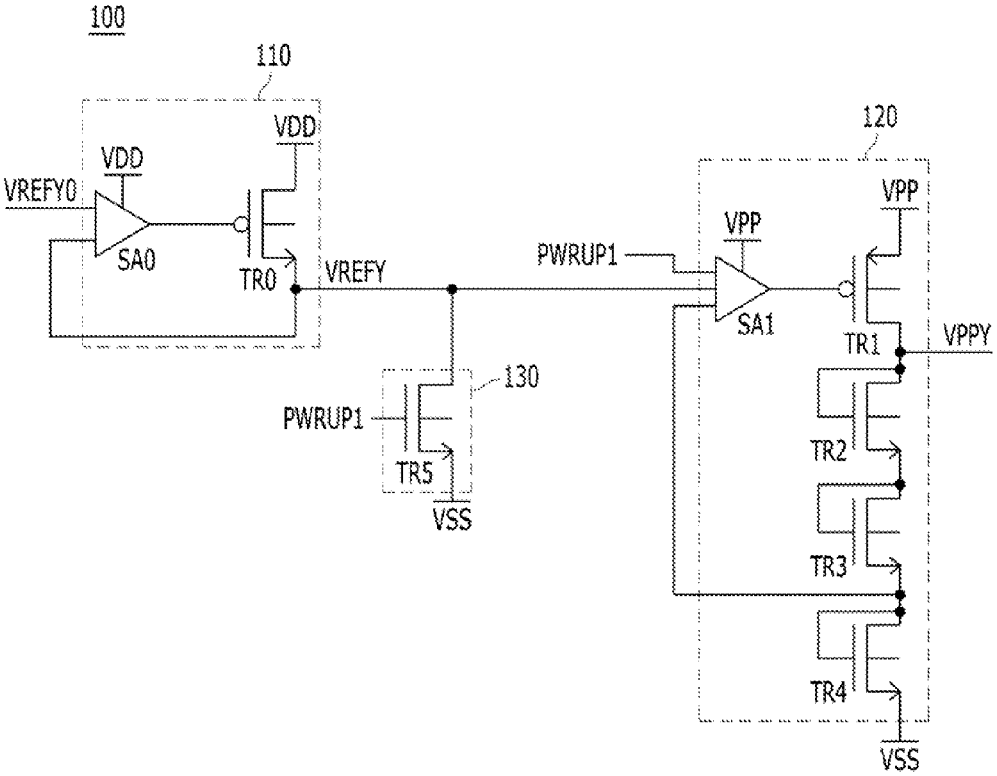
FIG. 2 is a circuit diagram illustrating an internal voltage generation block shown in FIG. 1.

FIG. 2 is a circuit diagram illustrating the internal voltage generation block 100 shown in FIG. 1.

Referring to FIG. 2, the internal voltage generation block 100 may include a reference voltage generation unit 110, an internal voltage generation unit 120, and a control unit 130. The reference voltage generation unit 110 generates a reference voltage VREFY corresponding to the seed voltage VREFY0 based on the second external voltage VDD. The internal voltage generation unit 120 generates the internal voltage VPPY corresponding to the reference voltage VREFY based on the first external voltage VPP and is disabled during the second power-up section in response to the second power-up signal PWRUP1. The control unit 130 fixes the reference voltage VREFY to a ground voltage VSS during the second power-up section in response to the second power-up signal PWRUP1.

The reference voltage generation unit 110 may include a first comparison circuit SA0 and a first driving circuit TR0. The first comparison circuit SA0 compares the reference voltage VREFY with the seed voltage VREFY0. The first driving circuit TR0 drives a reference voltage (VREFY) node to the second external voltage VDD in response to an output signal of the first comparison circuit SA0.

The internal voltage generation unit 120 may include a second comparison circuit SA1, a second driving circuit TR1, and a division circuit TR2, TR3 and TR4. The second comparison circuit SA1 compares a division voltage with the reference voltage VREFY. The second driving circuit TR1 drives an internal voltage (VPPY) node to the first external voltage VPP in response to an output signal of the second comparison circuit SA1. The division circuit TR2, TR3 and TR4 generates the division voltage by dividing the internal voltage VPPY into a predetermined division ratio.

Herein, the second comparison circuit SA1 may be disabled during the second power-up section in response to the second power-up signal PWRUP1. Although not illustrated in the drawing, the second comparison circuit SA1 may be disabled during the control section in response to the first and second power-up signals PWRUP0 and PWRUP1. The second comparison circuit SA1 is disabled during the second power-up section or the control section in order to control the internal voltage (VPPY) node to float during the second power-up section or the control section.

The control unit 130 may include a third driving circuit TR5. The third driving circuit TR5 drives the reference voltage (VREFY) node to the ground voltage VSS during the second power-up section in response to the second power-up signal PWRUP1. Although not illustrated in the drawing, the control unit 130 may drive the reference voltage (VREFY) node to the ground voltage VSS during the control section in response to the first and second power-up signals PWRUP0 and PWRUP1. The control unit 130 drives the reference voltage (VREFY) node to the ground voltage VSS in order to additionally disable the second comparison circuit SA1. In other words, the second comparison circuit SA1 may be primarily disabled in response to the second power-up signal PWRUP1 and secondarily disabled based on a level of the reference voltage VREFY.

Figure 3:
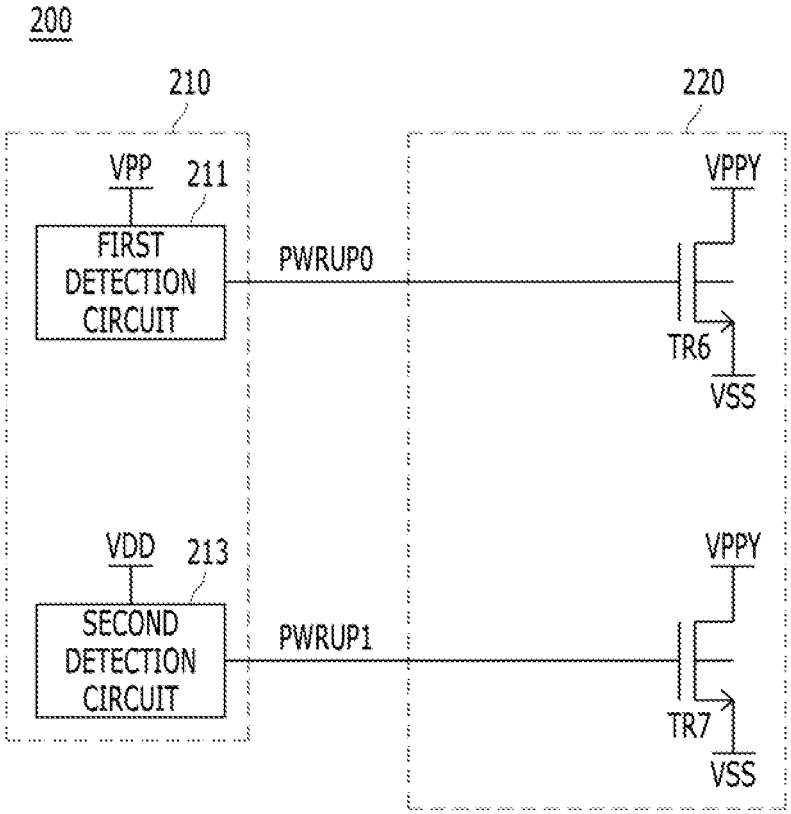
FIG. 3 is a circuit diagram illustrating a control block shown in FIG. 1.

FIG. 3 is a circuit diagram illustrating the control block 200 shown in FIG. 1.

Referring to FIG. 3, the control block 200 may include a detection unit 210 and a driving unit 220. The detection unit 210 detects the first power-up section based on the first external voltage VPP and the second power-up section based on the second external voltage VDD. The driving unit 220 drives the internal voltage (VPPY) node to the ground voltage VSS during the control section based on a detection result of the detection unit 210.

The detection unit 210 may include a first detection circuit 211 and a second detection circuit 213. The first detection circuit 211 detects the first power-up section to generate a first power-up signal PWRUP0. The second detection circuit 213 detects the second power-up section to generate the second power-up signal PWRUP1. Since the first and second detection circuits 211 and 213 are widely known to those skilled in the art, a detailed description on them is omitted herein.

The driving unit 220 may include a fourth driving circuit TR6 and a fifth driving circuit TR7. The fourth driving circuit TR6 drives the internal voltage (VPPY) node to the ground voltage VSS during the first power-up section in response to the first power-up signal PWRUP0. The fifth driving circuit TR7 drives the internal voltage (VPPY) node to the ground voltage VSS during the second power-up section in response to the second power-up signal PWRUP1.

Figure 4:
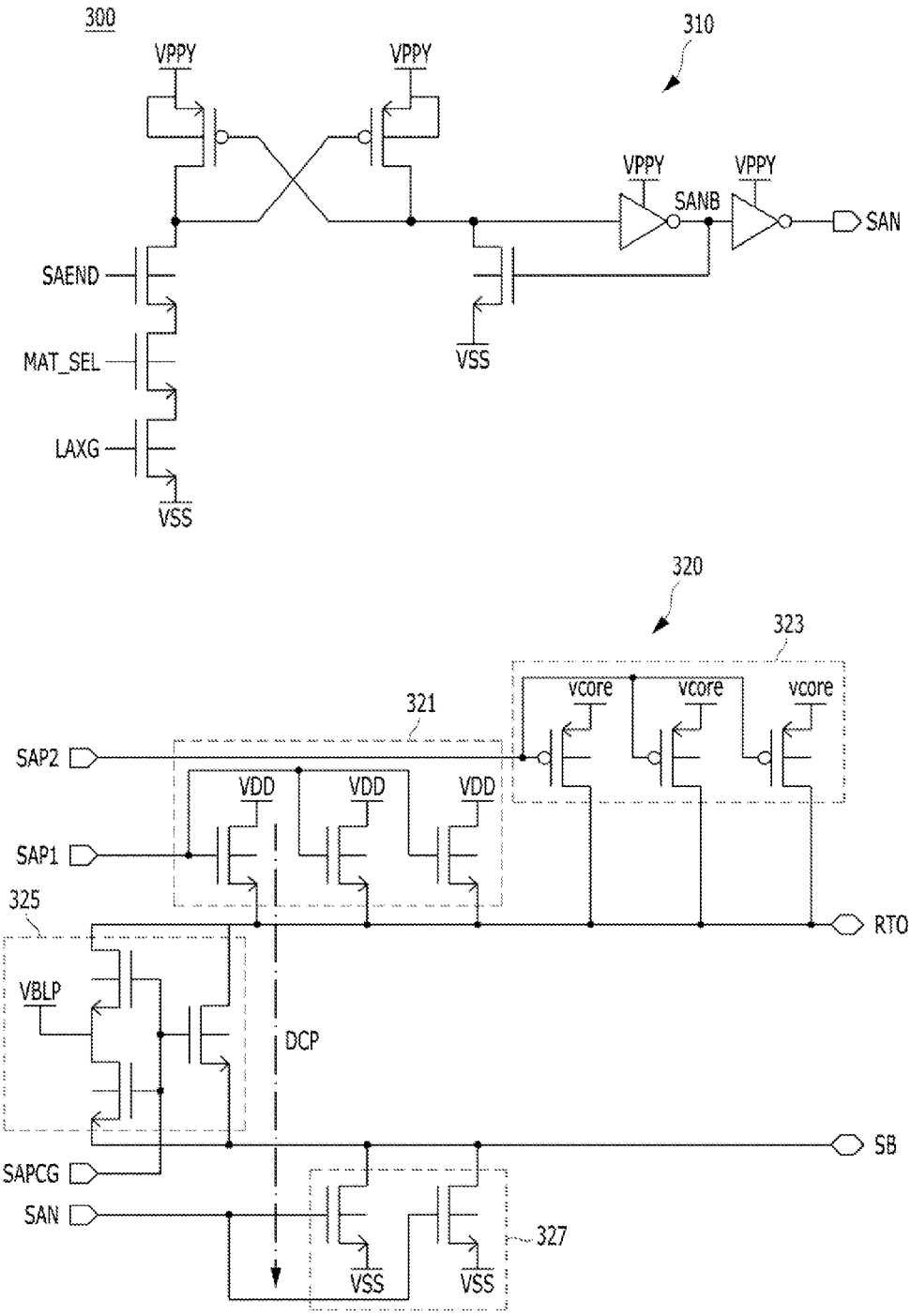
FIG. 4 is a circuit diagram illustrating an internal circuit block shown in FIG. 1.

FIG. 4 is a circuit diagram illustrating the internal circuit block 300 shown in FIG. 1. In FIG. 4, only a portion of a configuration of the internal circuit block 300 is shown, and internal voltages such as a core voltage VCORE and a precharge voltage VBLP and internal signals such as address decoding signals SAEND, MAT_SEL and LAXG, first and second pull-up control signals SAP1 and SAP2, and an equalization signal SAPCG may be received from other internal circuits.

Referring to FIG. 4, the internal circuit block 300 may include a pull-down control unit 310 and a voltage supply unit 320. The pull-down control unit 310 generates a pull-down control signal SAN based on the internal voltage VPPY. The voltage supply unit 320 selectively supplies the second external voltage VDD and the core voltage VCORE to a first power source line RTO in response to the first and second pull-up control signals SAP1 and SAP2 and supplies the ground voltage VSS to a second power source line SB in response to the pull-down control signal SAN.

The pull-down control unit 310 may generate the pull-down control signal SAN that swings between the ground voltage VSS and the internal voltage VPPY in response to the address decoding signals SAEND, MAT_SEL and LAXG that swing between the ground voltage VSS and the second external voltage VDD. Particularly, the pull-down control unit 310 may generate the pull-down control signal SAN of a logic low level corresponding to the ground voltage VSS regardless of the address decoding signals SAEND, MAT_SEL and LAXG during the control section. For example, the pull-down control unit 310 may include a level shifter.

Since the address decoding signals SAEND, MAT_SEL and LAXG are generated based on the second external voltage VDD, the address decoding signals SAEND, MAT_SEL and LAXG may be in an unknown state during a section when the second external voltage VDD floats, which is the control section. Although the address decoding signals SAEND, MAT_SEL and LAXG of the unknown state become a logic high state, the pull-down control unit 310 may output the pull-down control signal SAN of a logic low level, not a logic high level, during the control section. This is because both the internal voltage VPPY, used as a source power supply, and a sink power supply (not shown) of an inverter, disposed at an output terminal of the pull-down control unit 310, have a ground voltage (VSS) level.

The voltage supply unit 320 may include a sixth driving circuit 321, a seventh driving circuit 323, an equalization circuit 325, and an eighth driving circuit 327. The sixth driving circuit 321 drives the first power source line RTO to the second external voltage VDD in response to the first pull-up control signal SAP1. The seventh driving circuit 323 drives the first power source line RTO to the core voltage VCORE in response to the second pull-up control signal SAP2. The equalization circuit 325 equalizes the first and second power source lines RTO and SB to the precharge voltage VBLP in response to the equalization signal SAPCG. The eighth driving circuit 327 drives the second power source line SB to the ground voltage VSS in response to the pull-down control signal SAN.

Since the pull-down control signal SAN is in a logic low state even though the first pull-up control signal SAP1 and the equalization signal SAPCG are enabled to a logic high state, the voltage supply unit 320 may block a direct current path DCP from being formed between a second external voltage (VDD) terminal and a ground voltage (VSS) terminal through the sixth driving circuit 321, the equalization circuit 325 and the eighth driving circuit 327. Only when the eighth driving circuit 327 has its current sink disabled, based on the pull-down control signal SAN, does a direct current path DCP fail to form, regardless of the enabling of the sixth driving circuit 321 and the equalization circuit 325.

Hereinafter, a method of driving a semiconductor device having the aforementioned structure is described with reference to FIGS. 1 to 5.

Figure 5:
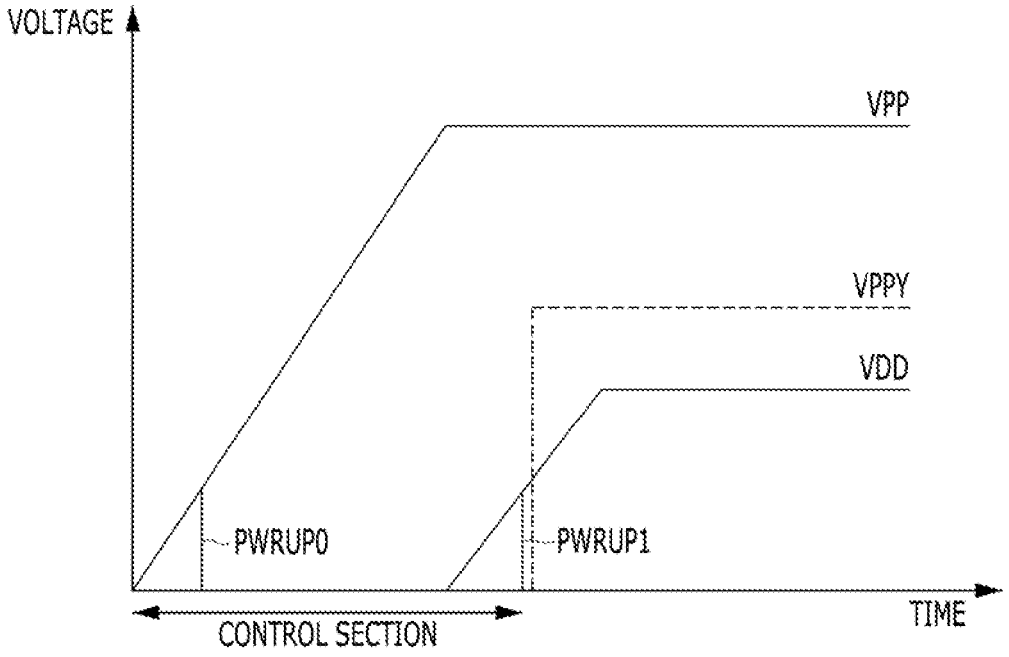
FIG. 5 is a timing diagram describing a method of driving a semiconductor device in accordance with an embodiment of the present invention.

FIG. 5 is a timing diagram describing a method of driving the semiconductor device in accordance with an embodiment of the present invention.

Referring to FIG. 5, the control block 200 may detect the first and second power-up sections of the first and second external voltages VPP and VDD, and maintain the internal voltage VPPY at the ground voltage (VSS) level during the control section including the first power-up section of the first external voltage VPP and the second power-up section of the second external voltage VDD that are detected. For example, the first detection circuit 211 may detect the first power-up section based on the first external voltage VPP to generate the first power-up signal PWRUP0, and the fourth driving circuit TR6 may drive the internal voltage (VPPY) node to the ground voltage VSS during the first power-up section in response to the first power-up signal PWRUP0, and the second detection circuit 213 may detect the second power-up section based on the second external voltage VDD to generate the second power-up signal PWRUP1, and the fifth driving circuit TR7 may drive the internal voltage (VPPY) node to the ground voltage VSS during the second power-up section in response to the second power-up signal PWRUP1.

The internal voltage generation block 100 may be disabled in response to at least one of the first and second power-up signals PWRUP0 and PWRUP1. For example, the second comparison circuit SA1 may be primarily disabled during the control section in response to the first and second power-up signals PWRUP0 and PWRUP1 and secondarily disabled in response to the reference voltage VREFY of the ground voltage (VSS) level. Since the second driving circuit TR1 is disabled when the second comparison circuit SA1 is disabled, the second driving circuit TR1 does not supply the first external voltage VPP to the internal voltage (VPPY) node during the control section.

The internal circuit block 300 may block a portion of its internal current path during the control section based on the internal voltage VPPY. For example, the pull-down control unit 310 may generate the pull-down control signal SAN of a logic low state regardless of the address decoding signals SAEND, MAT_SEL and LAXG during the control section, and the eighth driving circuit 327 of the voltage supply unit 320, which serves as a sinking unit, may be disabled in response to the pull-down control signal SAN. Therefore, the direct current path DCP that may be formed between the second external voltage (VDD) terminal and the ground voltage (VSS) terminal through the sixth driving circuit 321, the equalization circuit 325, and the eighth driving circuit 327 may be blocked during the control section.

In accordance with the embodiments of the present invention, leakage current may be reduced as a sinking unit that may form an internal current path is disabled while an external voltage floats.

While the present invention has been described with respect to specific embodiments, the embodiments are not intended to be restrictive, but rather descriptive. Further, it is noted that the present invention may be achieved in various ways through substitution, change, and modification, by those skilled in the art without departing from the scope of the present invention as defined by the following claims.

What is claimed is:

1. A semiconductor device comprising:

an internal voltage generation block suitable for generating an internal voltage based on first and second external voltages whose power-up sections are different from each other;

a control block suitable for fixing the internal voltage to a predetermined voltage level during a control section including a first power-up section of the first external voltage and a second power-up section of the second external voltage;

a pull-down control block suitable for receiving the internal voltage and generating a pull-down control signal of a logic level corresponding to the internal voltage during the control section; and a voltage supply block suitable for supplying the second external voltage to a first power source line and the ground voltage to a second power source line while blocking a portion of an internal current path during the control section in response to the pull-down control signal.

2. The semiconductor device of claim 1, wherein the control block includes an intermission between the first and second power-up sections.

3. The semiconductor device of claim 1, wherein a first power-up moment when the first power-up section starts is earlier than a second power-up moment when the second power-up section starts.

4. The semiconductor device of claim 1, wherein the control block includes:

a detection unit suitable for detecting the first power-up section based on the first external voltage and the second power-up section based on the second external voltage; and a driving unit suitable for driving an internal voltage node to a ground voltage during the first and second power-up sections based on a detection result of the detection unit.

5. The semiconductor device of claim 4, wherein the internal voltage generation block is disabled during the second power-up section or the control section based on the detection result of the detection unit.

6. The semiconductor device of claim 1, wherein the pull-down control block includes a level shifter for generating the pull-down control signal in response to an address decoding signal.

7. The semiconductor device of claim 1, wherein the internal current path includes a direct current path that is formed between a supply terminal of the second external voltage and a supply terminal of the ground voltage.

8. The semiconductor device of claim 1, wherein the voltage supply block includes:

a third driving circuit suitable for driving the first power source line to the second external voltage in response to a pull-up control signal;

an equalization circuit suitable for equalizing the first and second power source lines in response to an equalization signal; and a fourth driving circuit suitable for driving the second power source line to the ground voltage in response to the pull-down control signal, wherein the fourth driving circuit is disabled during the control section.

9. A semiconductor device comprising:

a reference voltage generation block suitable for generating a reference voltage corresponding to a seed voltage based on a second external voltage;

an internal voltage generation block suitable for generating an internal voltage corresponding to the reference voltage based on the first external voltage, wherein the internal voltage generation block is disabled in response to first and/or second power-up signals;

a detection block suitable for detecting a first power-up section based on the first external voltage and a second power-up section based on the second external voltage to output the first and second power-up signals;

a driving block suitable for driving an internal voltage node to a ground voltage during a control section including the first and second power-up sections in response to the first and second power-up signals;

a pull-down control block suitable for receiving the internal voltage and generating a pull-down control signal of a logic level corresponding to the internal voltage during the control section; and a voltage supply block suitable for supplying the second external voltage to a first power source line and the ground voltage to a second power source line while blocking a portion of an internal current path during the control section in response to the pull-down control signal.

10. The semiconductor device of claim 9, wherein a first power-up moment, when the first power-up section starts, is earlier than a second power-up moment when the second power-up section starts.

11. The semiconductor device of claim 9, further comprising:

a control block suitable for fixing the reference voltage to the ground voltage during the second power-up section or the control section in response to at least one of the first and second power-up signals.

12. The semiconductor device of claim 9, wherein the detection block includes:

a first detection circuit suitable for detecting the first power-up section of the first external voltage to generate the first power-up signal; and a second detection circuit suitable for detecting the second power-up section of the second external voltage to generate the second power-up signal.

13. The semiconductor device of claim 12, wherein the driving block includes:

a first driving circuit suitable for driving the internal voltage node to the ground voltage during the first power-up section in response to the first power-up signal; and a second driving circuit suitable for driving the internal voltage node to the ground voltage during the second power-up section in response to the second power-up signal.

14. The semiconductor device of claim 9, wherein the pull-down control block includes a level shifter for generating the pull-down control signal in response to an address decoding signal.

15. The semiconductor device of claim 9, wherein the internal current path includes a direct current path that is formed between a supply terminal of the second external voltage and a supply terminal of the ground voltage.

16. The semiconductor device of claim 9, wherein the voltage supply block includes:

a third driving circuit suitable for driving the first power source line to the second external voltage in response to a pull-up control signal;

an equalization circuit suitable for equalizing the first and second power source lines in response to an equalization signal; and a fourth driving circuit suitable for driving the second power source line to the ground voltage in response to the pull-down control signal, wherein the fourth driving circuit is disabled during the control section.

* * * * *